US008662323B1

(12) United States Patent
Billman

(10) Patent No.: US 8,662,323 B1
(45) Date of Patent: Mar. 4, 2014

(54) WALL SUPPORT SHELF KIT

(75) Inventor: Brian Lee Billman, Saginaw, MN (US)

(73) Assignee: Real Closet, Inc., Duluth, MN (US)

( * ) Notice: Subject to any disclaimer, the term of this patent is extended or adjusted under 35 U.S.C. 154(b) by 374 days.

(21) Appl. No.: 12/643,435

(22) Filed: Dec. 21, 2009

(51) Int. Cl.
*A47F 5/08* (2006.01)

(52) U.S. Cl.
USPC ... 211/94.01; 211/187; 312/245; 248/223.41; 248/250

(58) Field of Classification Search
USPC ..... 211/87.01, 90.01, 90.02, 90.03, 94.01, 211/94.02, 186, 187; 312/107, 108, 111, 312/245, 246; 108/193; 248/225.11, 248/225.21, 235, 250
See application file for complete search history.

(56) References Cited

U.S. PATENT DOCUMENTS

| | | | | |
|---|---|---|---|---|
| 1,954,242 | A | 4/1934 | Heppenstall | |
| 2,031,718 | A * | 2/1936 | Kress | 211/87.01 |
| 2,065,133 | A | 12/1936 | Heppenstall | |
| 2,708,292 | A | 5/1955 | Budai | |
| 2,813,359 | A | 11/1957 | Ferdinand | |
| 2,951,606 | A | 9/1960 | Benson | |
| 3,042,978 | A * | 7/1962 | Eames et al. | 52/32 |
| 3,186,363 | A | 6/1965 | Moore | |
| 3,278,149 | A | 10/1966 | Brucker | |
| 3,326,149 | A | 6/1967 | Mitchell et al. | |
| 3,379,483 | A | 4/1968 | Oldford | |
| 3,425,568 | A * | 2/1969 | Albright | 211/87.01 |
| 3,688,915 | A | 9/1972 | Ramsey | |
| 3,899,228 | A * | 8/1975 | Schreiber | 312/257.1 |
| 3,966,159 | A * | 6/1976 | Brown | 248/250 |
| 4,077,333 | A | 3/1978 | Ballas | |
| 4,125,338 | A | 11/1978 | Lew | |
| 4,197,950 | A | 4/1980 | Ovitz, III | |
| 4,329,003 | A | 5/1982 | Manchester | |
| 4,372,516 | A | 2/1983 | Nyquist | |
| 4,457,436 | A | 7/1984 | Kelley | |
| 4,688,687 | A | 8/1987 | Pryor | |
| 4,693,382 | A | 9/1987 | Galen | |
| 4,720,016 | A | 1/1988 | Kay | |
| 4,731,960 | A | 3/1988 | Sease | |
| 4,792,195 | A | 12/1988 | Adriaansen et al. | |
| 4,928,833 | A * | 5/1990 | Huizenga | 211/187 |
| 4,995,323 | A | 2/1991 | Kellems et al. | |
| 4,996,817 | A | 3/1991 | Nelson | |
| 5,050,832 | A * | 9/1991 | Lee et al. | 248/225.11 |
| 5,085,155 | A | 2/1992 | Ballard | |
| 5,097,771 | A * | 3/1992 | James, III | 108/42 |
| 5,127,340 | A * | 7/1992 | Maro et al. | 108/107 |
| 5,203,639 | A | 4/1993 | Femrite | |
| 5,222,611 | A * | 6/1993 | Wood et al. | 211/94.01 |
| 5,322,173 | A | 6/1994 | Kay | |

(Continued)

FOREIGN PATENT DOCUMENTS

DE 3047532 A1 12/1980

*Primary Examiner* — Joshua Rodden
(74) *Attorney, Agent, or Firm* — Sherrill Law Offices, PLLC

(57) ABSTRACT

The present invention is a wall shelf support assembly. The wall shelf support assembly includes first and second transversely elongated rails each with a transversely extending keyway and first and second side panels each defining a plane. The opposing side panels each have first and second major surfaces, a pair of opposed ends and a pair of opposed edges. Each panel is fitted with first and second keys configured and arranged for cooperatively engaging the keyways in the first and second rails respectfully. The keys extend within the plane of the side panel in opposite directions from opposed ends proximate to and parallel with a same edge.

12 Claims, 7 Drawing Sheets

(56) References Cited

U.S. PATENT DOCUMENTS

| | | | | | |
|---|---|---|---|---|---|
| 5,337,905 | A | | 8/1994 | Gast | |
| 5,349,909 | A | | 9/1994 | Smit et al. | |
| 5,392,934 | A | | 2/1995 | Fox | |
| 5,439,123 | A | * | 8/1995 | Nook | 211/187 |
| 5,467,562 | A | | 11/1995 | Holland | |
| 5,582,306 | A | * | 12/1996 | Balter et al. | 211/187 |
| 5,605,238 | A | | 2/1997 | Jacobs | |
| 5,697,507 | A | * | 12/1997 | Blass | 211/94.01 |
| 5,718,493 | A | | 2/1998 | Nikolai | |
| 5,762,213 | A | * | 6/1998 | Heneveld, Sr. | 211/187 |
| 5,813,737 | A | * | 9/1998 | Stone | 312/257.1 |
| 5,819,958 | A | * | 10/1998 | Dement | 211/90.01 |
| 5,908,119 | A | | 6/1999 | Kump et al. | |
| 5,964,438 | A | * | 10/1999 | Camilleri | 248/225.21 |
| 6,129,222 | A | | 10/2000 | Mylander et al. | |
| 6,183,585 | B1 | | 2/2001 | Kelley | |
| 6,209,976 | B1 | | 4/2001 | Shear | |
| 6,374,547 | B1 | | 4/2002 | Baloga et al. | |
| 6,786,337 | B2 | | 9/2004 | Klein et al. | |
| 6,800,353 | B1 | | 10/2004 | Anderson et al. | |
| 6,902,785 | B2 | * | 6/2005 | Ourth | 428/40.1 |
| 6,915,913 | B2 | | 7/2005 | Cardinell | |
| 6,988,628 | B2 | | 1/2006 | Krieger et al. | |
| 7,083,056 | B2 | * | 8/2006 | Routhier | 211/90.04 |
| 7,255,237 | B2 | | 8/2007 | Stitchick et al. | |
| 7,314,144 | B2 | | 1/2008 | Stitchick et al. | |
| 7,384,107 | B2 | | 6/2008 | Humberto | |
| 7,392,911 | B2 | | 7/2008 | Stitchick et al. | |
| 2002/0104813 | A1 | * | 8/2002 | Routhier | 211/90.04 |
| 2005/0184630 | A1 | | 8/2005 | Bonanno et al. | |
| 2006/0091271 | A1 | * | 5/2006 | Nowak | 248/225.21 |
| 2006/0243688 | A1 | * | 11/2006 | Gilcrest et al. | 211/87.01 |
| 2008/0001511 | A1 | * | 1/2008 | Amlang et al. | 312/245 |
| 2008/0010935 | A1 | | 1/2008 | Nagel et al. | |
| 2008/0224579 | A1 | | 9/2008 | Juten | |
| 2010/0116762 | A1 | * | 5/2010 | Piersant et al. | 211/90.01 |

* cited by examiner

WALL SUPPORT SHELF KIT

BACKGROUND

Closet shelving systems have been manufactured and installed in residential and commercial buildings for storage of personal or commercial items. The size, strength and versatility of the closet shelving systems are of particular concern with any new or existing installation. The closed shelving system should be aesthetically pleasing while maintaining the desired functionality desired by the user. With storage space at a premium efficient use of shelving space is a must along with the ability to quickly and easily change the configuration or layout of the shelves with minimum need for tear down and reconstruction of the entire system.

In the prior art, closet shelves are constructed from plastic coated wire or partitioned wood sections and the size, strength and flexibility of the shelf is determined from that particular structure. However, such designs are limited by their construction size and weight bearing load and are difficult to change the layout once originally constructed.

U.S. Pat. No. 4,688,687 to Pryor describes a closet storage arrangement with vertical supports resting on the floor and a hang bar interposed between.

U.S. Pat. No. 5,322,173 to Kay describes a ventilated wooden shelf with cylindrical stubs attaching each separate flat shelf member to holes cut into support beams.

United States Patent Publication No. 2005/0184630 A1 to Bonanno et al. describes a storage system configured with support brackets which fit into pre cut cavities of opposing walls.

United States Patent Publication No. 2008/0224579 A1 to Juten describes a modular storage system with rails secured to a wall and the storage units that hang over the rails flush against the wall.

U.S. Pat. No. 6,988,628 to Krieger et al. describes a closet storage system with an engagable and lockable closet rod.

U.S. Pat. No. 7,255,237 to Stitchick et al. describes an organizer system with a mounting rail secured to a wall and support uprights which hang from the mounting rail secured by clips.

Closet shelves in the prior art are supported by wedges or notches on the side of the vertical support columns. A wall support, screwed or drilled to a wall has an extension piece extending off at an angle suitable to fit into the notch of the vertical column so as to "hang" the column off to one side of the wall support. The prior art wall support extension piece would fit into a cutout notch on the vertical column. The weight that can be supported by the shelf is dependent on the extension piece of the vertical column which fits into the notch on the column. At the angle which the extension piece protrudes to one side from the wall support subjects it to bend or break with increased load. In addition, the notch or cutout in the vertical column has a tendency to chip or crack lessening the supportable load and destroying the aesthetic appeal of the shelf system. Therefore, a need exists for a versatile, heavy weight supporting shelf system.

SUMMARY OF THE INVENTION

A first embodiment of the present invention is a wall shelf support kit. The wall shelf support kit includes first and second transversely elongated rails each with a transversely extending keyway and first and second side panels each defining a plane. The opposing side panels each have first and second major surfaces, a pair of opposed ends and a pair of opposed edges. Each panel is fitted with first and second keys configured and arranged for cooperatively engaging the keyways in the first and second rails respectfully. The keys extend within the plane of the side panel in opposite directions from opposed ends proximate to and parallel with a same edge.

A second embodiment of the present invention is a wall shelf support system. The wall shelf support system includes first and second transversely elongated rails each with a transversely extending keyway and first and second side panels each defining a plane mounted to a wall a vertical distance apart. The opposing side panels each have first and second major surfaces, a pair of opposed ends and a pair of opposed edges. Each panel is fitted with first and second keys cooperatively engaging the keyways in the first and second rails respectfully. The keys extend within the plane of the side panel in opposite directions from opposed ends proximate to and parallel with a same edge.

A third embodiment of the present invention is a method of shelf construction includes obtaining a wall shelf support system as defined in the first embodiment. The method of mounting the wall shelf support assembly further comprises the steps of a) mounting the first and second transversely elongated rails to a wall at a vertical distance apart, b) fitting the first and second keys to the bottom and top edges of the first and second side panels respectfully, c) inserting the first key of the first side panel into the keyway of the first transversely elongated rail and inserting the second key of the first side panel into the keyway of the second transversely elongated rail, and d) inserting the first key of the opposing second side panel into the keyway of the first transversely elongated rail and inserting the second key of the second side panel into the keyway of the second transversely elongated rail.

DETAILED DESCRIPTION OF A PREFERRED EMBODIMENT

Nomenclature

10 Shelf

20 Support Structure

Figure 1:
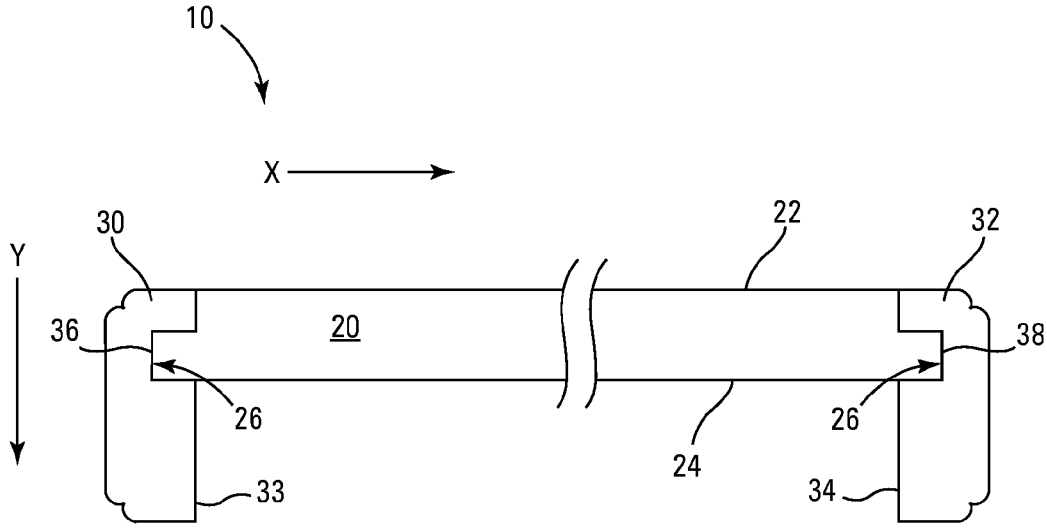
FIG. 1 is a side perspective view of the twin beam shelf with laterally extending lips.

22 First Major Surface
23 Rear Edge
24 Second Major Surface
25 Front Edge
26 Adhesive Joint
30 Rear Beam
32 Front Beam
33 Rear Lip
34 Front Lip
36 Front Dado
38 Rear Dado
50 Set of Rails
51 Lower Rail
52 Upper Rail
53 Recess
56 Keyway
58 Rounded Edge
60 Key
61 First Key
62 Second Key
64 Arm
65 Rounded Arm Surface
66 Peg
68 Fastener
70 Side Panel
71 Bottom End
72 Top End
73 Front Edge
74 Holes
75 Rear Edge
76 Alignment Holes
77 First Major Surface
78 Alignment Pin
79 Second Major Surface
110 Panel Extension
112 Notch
113 Front Edge
114 First Major Surface
115 Rear Edge
116 Second Major Surface
118 Top End
119 Bottom End
120 Alignment Peg
122 Alignment Holes
130 C-Clip
140 Bottom Extension Rail
200 Support Wall
x Longitudinal Direction
y Lateral Direction
Transverse Direction Construction Depicted in FIGS. 4-9 and 12, the wall shelf support kit is assembled on a support wall 200 with a plurality of twin beam shelves 10 that may be secured to the opposing side panels 70. The wall shelf support kit includes top and bottom rails 52, 51, two opposing side panels 70 and first 61 and second 62 keys secured to the top 72 and bottom 71 ends of the side panels 70. The first and second keys 61, 62 are mounted to the side panel 70 and secure the side panel 70 to the wall 200.

Figure 2:
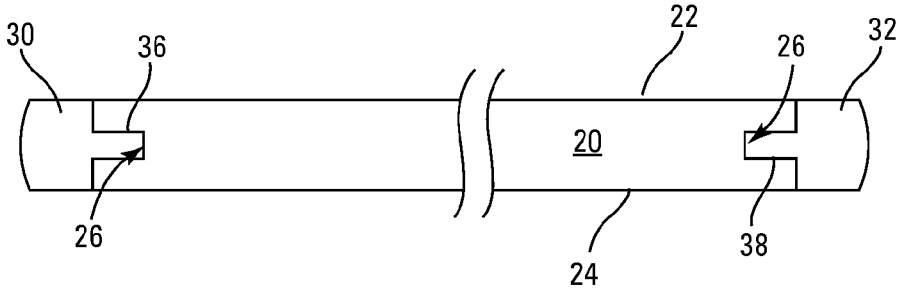
FIG. 2 is a side perspective view of the twin beam shelf without the laterally extending lips.
Figure 3:
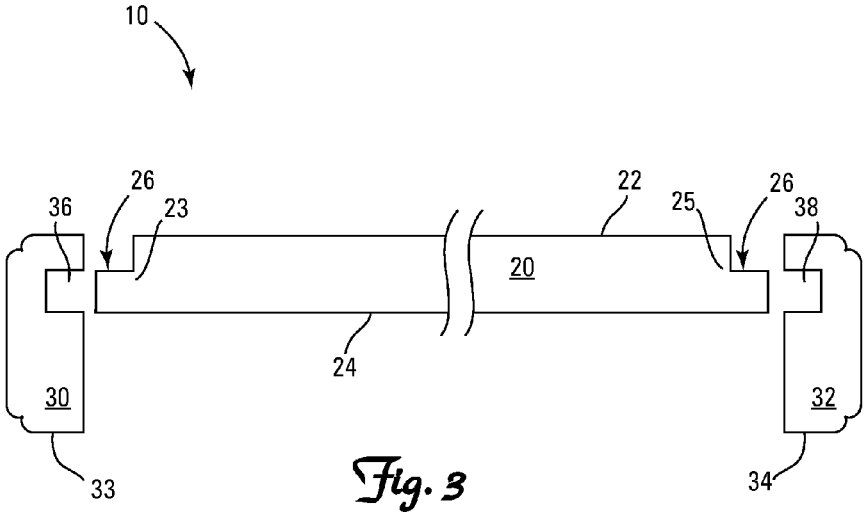
FIG. 3 is an exploded side perspective view of the twin beam shelf with laterally extending lips.

Referring to FIGS. 1-3, the twin beam shelf 10 has a dual wood or hybrid wood construction. Both the support structure 20 and the front and rear beams 32, 30 are a wood grain material including, but not limited to particle board, plywood or hardwood. The hardwood would include maple, oak, poplar, cherry, ash, walnut, hickory, mahogany, alder, aspen, basswood or beech. The twin beam shelf 10 consists entirely of wood grain materials which is preferable for cutting and fitting during installation. In addition, the dual wood construction is available for a finished wood appearance. The support structure 20 and beams 30, 32 may be stained to a desired color allowing for unique shelving designs. When the support structure 20 of the twin beam shelf 10 is plywood or particle board a wood grain melamine laminate print may be used to represent a stained hardwood finish. The front and rear beams 32, 30 which may be a hardwood when the support structure 20 is plywood or particle board, may have a commercially available ultra violet waterborne finish to match the coloring of the support structure 20.

Referring to FIG. 3, the twin beam shelf 10 includes front and rear rabbet cut edges 25, 23 of the support structure 20 spaced in the longitudinal direction x. Front and rear beams 32, 30 have front and rear dados 36, 38 defined as a rectangular grooves cut into the beams 32, 30 respectfully. The front and rear rabbet cut edges 25, 23 cooperatively engage the front and rear dados 36, 38 forming a four sided adhesive joint 26. An adhesive, such as wood glue, covers the four flush surfaces of the adhesive joint 26 securing the front and rear beams 32, 30 to the support structure 20. The four sided adhesive joint 26 extends the length of the support structure 20 greatly increasing the strength and shelf weight. A twin beam shelf 10 may extend approximately 60 inches in length, as opposed to the industry standard 30 inches, without intermittent bracing or underneath supports and without losing significant support strength. Because the twin beam shelf 10 is made of all wood grain material the size may be cut to fit any desired space greatly increasing the room for storage.

FIG. 1 depicts the front and rear beams 32, 30 extending in the lateral direction y below the second major surface 24 of the support structure 20 forming front and rear lips 34, 33. One example of the dimensions of the twin beam shelf 10 depicted in the FIG. 1 include a length of up to 60 inches, a shelf width in the longitudinal direction x of approximately 6-16 inches and an approximate 0.5-1 inch front and rear lip 34, 33 laterally extending from the second major surface 24 of the support surface 20. Longer shelving lengths ranging up to 60 inches are available and are proportional to the increased thickness and width of the support surface 20. The approximate measurements of the particular characteristics of the twin beam shelf 10 are dependent on the accuracy of the wood cuts and the saws used to make such cuts. These measurements are approximate and may be modified to fit a particular application or design.

A second embodiment in FIG. 2 depicts the support structure 20 with the front and rear wooden beams 32, 30 that do not extend laterally below the second major surface 24 but are flush with the first and second major surfaces 22, 24 of the support structure 20. The edges 25, 23 of the support structure 20 have a multiple side adhesive joint 26 cooperatively engaging the beams 32, 30. This shelf 10 without the lateral lips of the first embodiment still offers the increased support strength compared to the industry standard shelves and allows the edge to edge length to extend at least 60 inches with minimal loss of strength.

Figure 8:
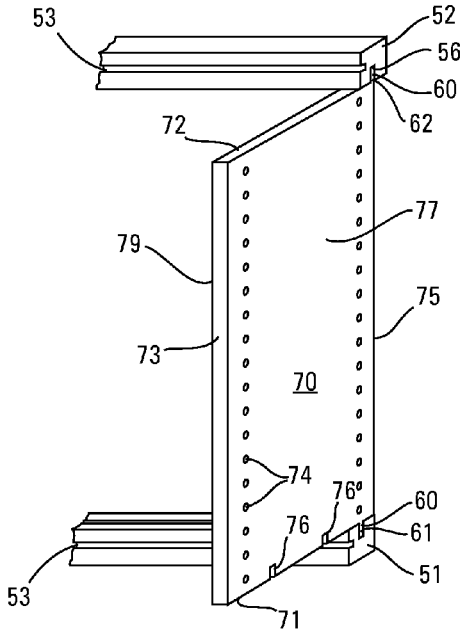
FIG. 8 is a front perspective view of the wall shelf support assembly with the rails, keys and side panel.
Figure 9:
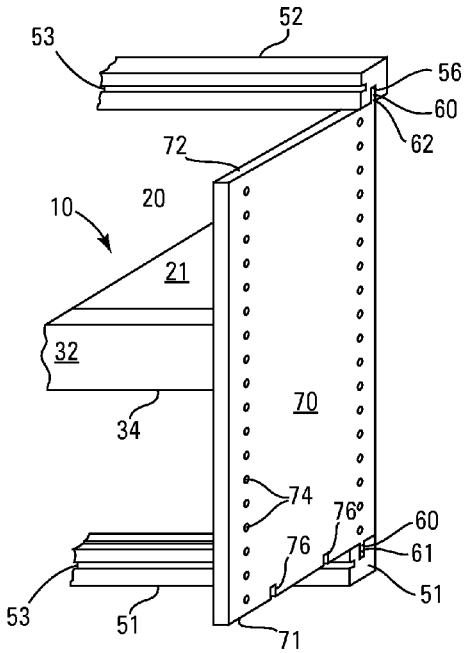
FIG. 9 is the wall shelf support assembly of FIG. 8 with a twin beam shelf mounted therein.

The wall shelf support kit shown assembled in FIGS. 8-9, includes a set of rails 50 that are secured to a wall 200 and extend along the wall in a transverse direction z. A set of opposing side panels 70 define first and second major surfaces 77, 79 and front and rear edges 73, 75. First and second keys 61, 62 are fitted to the keyway 56 of the lower and upper rails 51,52 respectfully and securing it to the wall 200. A lower rail 51 is secured at a user determined distance off the ground and will act as a support anchor for the side panel 70 such that the side panel 70 that will rest on the lower rail 51. The top rail 52 is spaced an approximate vertical distance from the lower rail 51 and secured to the wall 200. The top rail 52 serves as a top support and guide rail for the side panel 70. A spacer (not shown) may be used to allow the user to correctly space the upper and lower rail 52, 51 without the use of a separate measurement instrument. The upper and lower rails 52, 51 extend flush against the length of the wall 200 for the desired length of the twin beam shelf 10. The user is allowed to adjust the length of the twin beam shelf 10 to fit their particular design preferences and the length of the shelf 10 may extend up to 60 inches. A keyway 56 continuously extends the length of the rails 51, 52 allowing the first and second keys 61, 62 to attach within the keyway 56 anywhere along the rails 51, 52 thus easily adjusting the length of the twin beam shelf 10. An object (not shown) may insert within the keyway 56 to act as a stopper preventing the first and second keys 61, 62 from sliding out of position. The inserted object (not shown) may include but not limited to a screw or nail wedged in the keyway 56.

Figure 6:
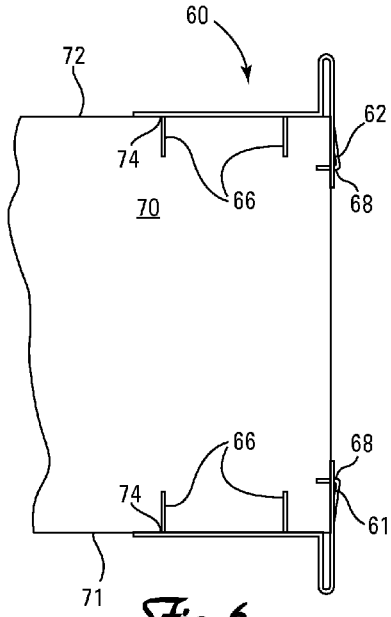
FIG. 6 is a side view of top and bottom keys mounted to the top and bottom surfaces of the side panel.

In FIG. 6, a first key 61 is mounted to the bottom end 71 of the side panel 70 and a second key 62 is mounted to the top end 72 either by nailing, screwing or fastening to pre-existing C-Clip mounting holes 74 in the side panel 70. The opposing side panels 70 range from 24-48 inches in vertical height. The first and second keys 61, 62 have extending pegs 66 which fit securely into top and bottom ends 72, 71 of the side panels 70 with an adhesive applied to secure the pegs 66. The first and second keys 61, 62 comprising the set of keys 60 may also be nailed or screwed in. The side panels 70, additionally, have predrilled alignment holes 76 in the top and bottom ends 72, 71 that will align with the alignment holes 122 drilled in a panel extension 110 ensuring a straight extension of the shelving uprights if a shelving height greater than 48 inches is desired.

Figure 4:
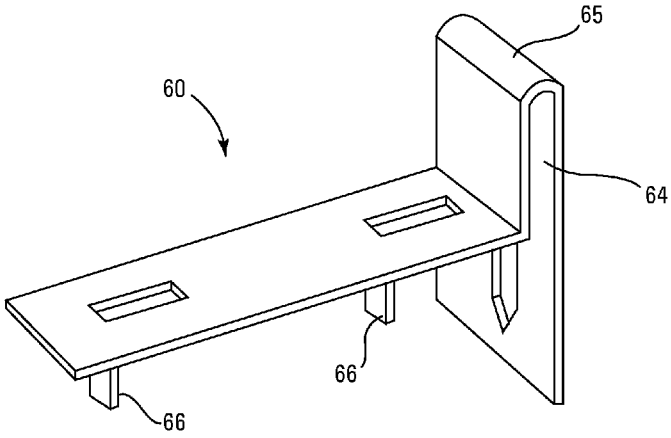
FIG. 4 is front perspective view of a key.
Figure 5:
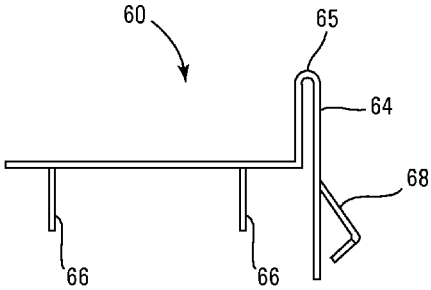
FIG. 5 is a side view of a key.

As shown in FIGS. 4-6, an arm 64 extends laterally from the base of each first and second keys 61, 62 in the same plane as the side panels 70. The arm 64 is at a close proximate distance to the rear edge 75 of the side panel 70 and extends laterally parallel with the rear edge 75 and is configured and arranged to frictionally secure within the keyway 56 within the upper and lower rails 52, 51 respectfully. The extending arm 64 has a rounded arm surface 65 to allow for easier slippage into the keyway 56. The first and second keys 61, 62 referred to as a set of keys 60, each include a fastener 68 that may be pounded in with a hammer to the side of the side panel 70. The fastener 68 prevents the first and second keys 61, 62 from twisting and shifting when mounted on the side panel 70. By preventing shifting the overall shelf construction is more stable. When the set of keys 60 are frictionally secured in the set of rails 50 movement is restricted and side panel 70 stabilized. The frictionally secure set of keys 60 within the set of rails 50 secures the side panel 70 to the wall 200.

Figure 7:
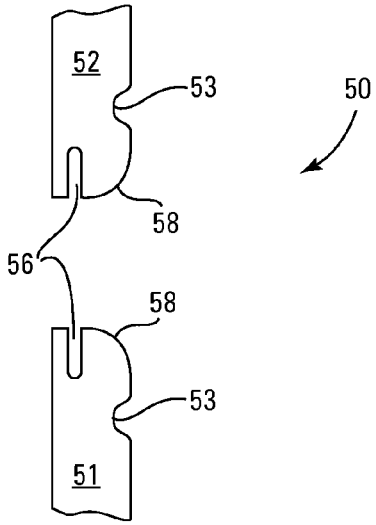
FIG. 7 is a side view of top and bottom rails.

FIG. 7 depicts a side view of the set of rails 50 that are a wood grain and screwed, nailed or secured using an adhesive to the support wall 200. The upper and lower rails 52, 51 would extend along the wall 200. A recess 53 may be present on the forward facing side of the upper and lower rails 52, 51 to obscure a nail or screw extending through to the support wall 200. The upper and lower rails 52, 51 have a keyway 56 to receive and secure the set of keys 60. The rounded edges 58 of the keyway 56 allow the arm 64 of the first and second keys 61, 62 to easily snap into place and be friction secured within the keyway 56. There is no need for additional tools or adhesives to secure the set of keys 60 to the set of rails 50.

As depicted in FIGS. 8-9 set of rails 50 secure the side panel 70 so the side panel 70 does not hang off the set of rails 50 where torque on the rails may cause damage to the wall 200 or chip or crack the side panel. The bottom rail 51 is mounted so that the side panel 70 will rest on it with the upper rail 52 securing the top end 72. Because the side panel 70 does not hang off of a protruding extension piece, the support weight of the side panel 70 is not dependent on an extending piece eliminating the danger of the protruding extension bending or snapping. No notches or grooves are cut into the sides of the side panel 70 and the protruding extension piece will not need to be fit into a notch carved out of the side panel 70. Eliminating wedges or cuts into the side panel 70 eliminates the possibility that chips or cracks may develop within or around the wedge due to prolonged use or exceeded weight limitations.

The side panels 70 range from 24-48 inches. The side panels 70 may be extended to a height of up to 72 inches using the panel extension 110. The increased vertical height is achieved by extending the length of the opposing side panels 70. A panel extension 110 may be mounted to either the top end 72 or bottom end 71 of the side panel 70 extending the overall vertical distance of the system. The panel extension 110 may mount to either top or bottom ends 72, 71 of the side panels 70 as depicted in FIGS. 13 and 14.

Figure 14:
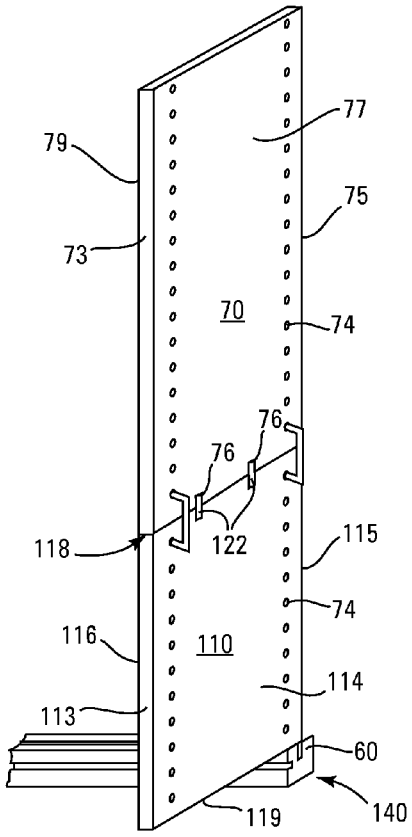
FIG. 14 is a side perspective view of the extension panel assembly mounted to the wall shelf support assembly.
Figure 13:
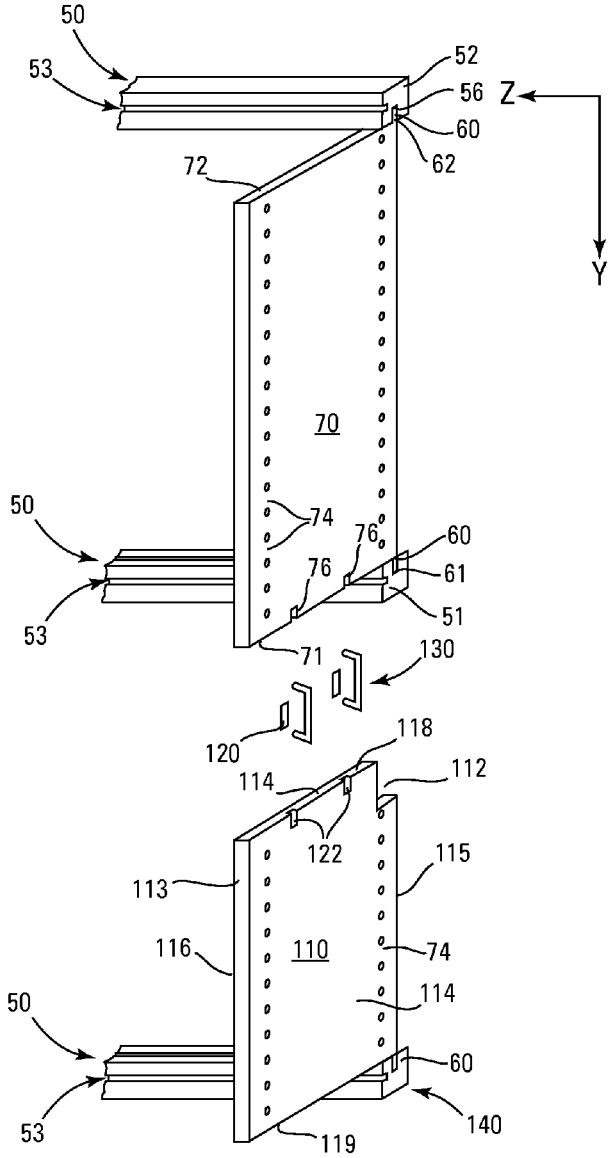
FIG. 13 is an exploded side perspective view of the extension panel assembly mounted to the wall shelf support assembly.

Depicted in FIGS. 13-14, the panel extension kit includes a panel extension 110, metal alignment pegs 120 and a set of C-Clips 130. The panel extension 110 has a notch 112 cut into a corner that corresponds to the position of either the top or bottom rails 52, 51 mounted to the support wall 200 allowing the panel extension 110 to fit flush with the support wall 200 and side panel 70. The notch 112 is located on the opposing corner of the mounted key 60.

Figure 12:
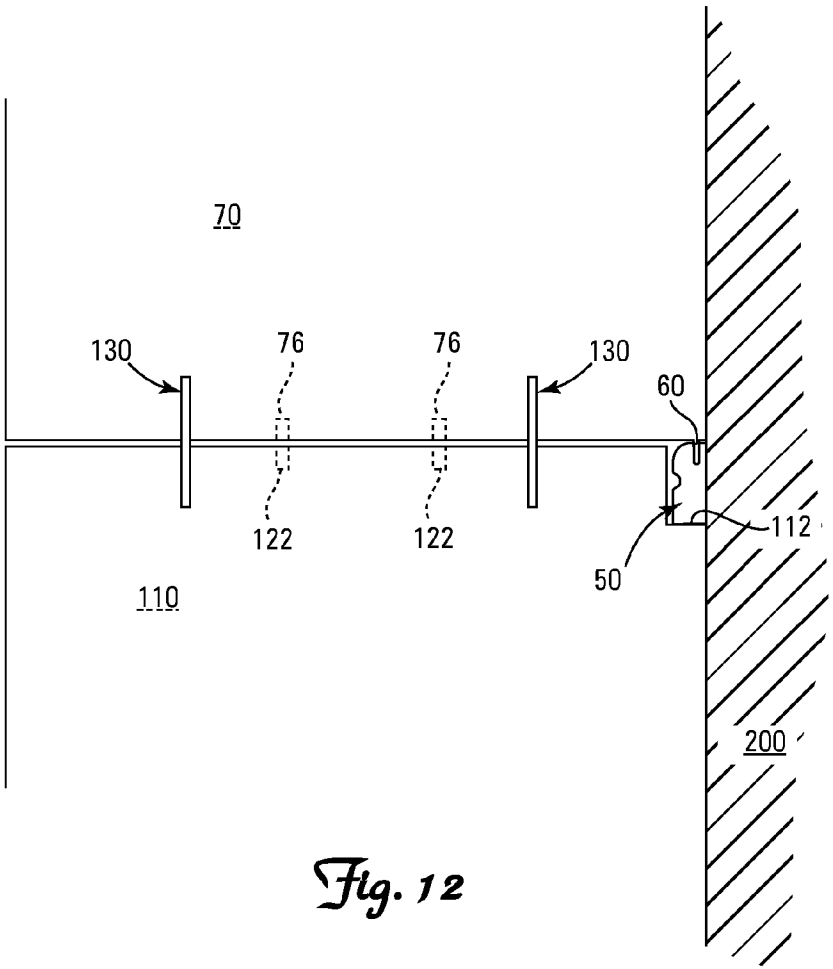
FIG. 12 is a side view of the C-Clip fastened to the side panel and extension panel depicted in FIG. 11.
Figure 11:
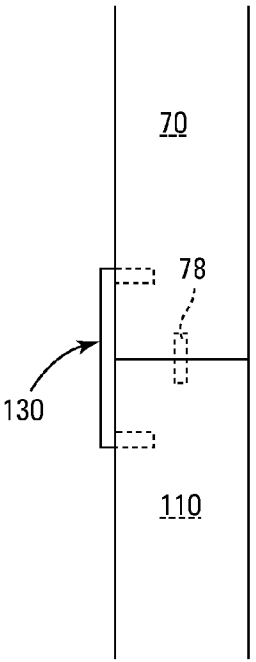
FIG. 11 is a front view of the C-Clip fastened to the side panel and extension panel.
Figure 10:
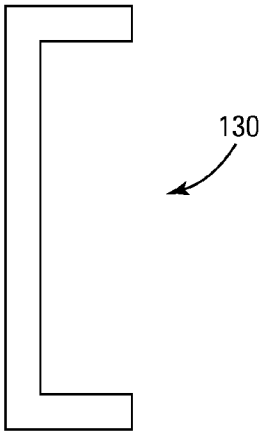
FIG. 10 is a side view of a C-Clip.

FIGS. 12-14 show the side panel 70 mounting between two rails 51, 52 bracing the side panel 70 to the wall 200. The side panel 70, the first and second keys 61, 62 and they are in the same plane defined by the side panel 70 when secured to the top and bottom rails 52, 51. The panel extension 110 defines first and second major surfaces 114, 116 and top and bottom 118, 119 and front and rear edges 113, 115 along with a notch 112 to fit around a mounted individual in a set of rails 50. The notch 112 cut into the corner defined by the intersection of the top end 118 and the rear edge 115 allows the panel extension 110 to fit around the bottom rail 51 and flush with the side panel 70 and the wall 200.

The panel extension 110 is up to 24 inches long and has a notch 112 cut out on at least one end to allow the panel extension 110 to fit around the bottom or top rails 51, 52 while still aligning with the mounted side panel 70 flush against the wall 200. The alignment holes 76 in the side panel 70 match with the alignment holes 122 in the panel extension 110 and are lined up with an alignment pin 78. The alignment holes 76 in both the side panel 70 and panel extension 110 align all sides so a smooth, seamless transition occurs between the side panel 70 and the panel extension 110 keeping with the overall aesthetic quality of the shelving arrangement. The notch 112 is in the opposing corner of the panel extension 110 as the mounted key 60.

The panel extension kit in FIGS. 13-14 wherein the panel extension 110 is secured to the side panel 70 by the C-Clips 130. A third bottom extension rail 140 is attached to the wall 200 below the panel extension 110 for support similar to the bottom rail 51 supporting the opposing side panels 70. The bottom end 119 has a key 60 attached and frictionally secured within the bottom extension rail 140. The arm 64 is in the same plane as the extension panel 110 and the side panel 70. The side panel 70, set of three keys 60, and the extension panel 110 are all in the same plane defined by the side panel 70 and panel extension 110 and proximate and parallel with the rear edge 75 of the side panel 70 and rear edge 115 of the panel extension 110 when mounted to the set of three rails 50.

A second embodiment is to mount the panel extension 110 on the top side of the side panel 70 extending the closet assembly in the upward vertical direction.

FIGS. 10-14 show a C-Clip 130 which fits into either the inner or outer sides of the side panel 70 or panel extension 110. The C-Clip 130 may securely mount in the holes 74 which may be drilled in the panel extension 110 and side panel 70. The C-Clip mounting holes 74 are spaced approximately equidistance from the front and rear edges 113, 115 of the panel extension 110 on a first major surface 114 to offer greater support when connected to the side panel 70. The C-Clips 130 may also be secured to the side panel 70 by drilling a hole in any user desired location. When the panel extension 110 is secured to the side panel 70 a plurality of twin beam selves 10 may be installed wherein the user determines the number of shelves, drawers and hang space as well and vertical and horizontal size of the twin beam shelf 10.

I claim:

1. A wall mounted shelf support assembly, comprising:

(a) upper and lower transversely elongated rails each with a transversely elongated keyway having a vertical depth, the rails mounted to a wall a defined vertical distance apart with the keyways in the rails facing towards one another, (b) first and second horizontally symmetrical side panels each defining a panel plane, each side panel vertically mounted onto the rails and having top and bottom ends and front and back edges that define top and bottom front corners and top and bottom back corners, wherein each side panel is secured to the rails by keys that vertically project in opposite directions from the back corners of the side panel into the keyways of the rails with the top back corner of the side panel projecting longitudinally underneath the upper rail, wherein (c) the defined vertical distance between the rails matches the vertical distance between the back corners of the side panels such that vertical lifting of the side panels is prevented by the location of the top back corner immediately underneath the upper rail.

2. The wall shelf support assembly in claim 1 wherein the upper and lower rails and first and second side panels are a material selected from a group which includes hardwood, plywood or particle board.

3. The wall shelf support assembly in claim 1 further including a shelf secured between the first and second side panels.

4. The wall shelf support assembly in claim 3 wherein the shelf has a transversely extending length of 30 inches-60 inches.

5. A method of shelf construction, comprising the steps of:

(a) obtaining a wall shelf support kit, comprising:

(i) first and second interchangeable transversely elongated rails each with a transversely elongated keyway having a vertical depth, and (ii) first and second horizontally symmetrical side panels each defining a panel plane, each side panel having (-) top and bottom ends and front and back edges that define top and bottom front corners and top and bottom back corners, and (-) keys that vertically project in opposite directions from the top and bottom back corners of the side panel, (b) horizontally mounting the first and second transversely elongated rails to a wall a defined vertical distance apart so as to define an upper rail and a lower rail, with the keyways in the rails facing towards one another, (c) separately and individually mounting each of the side panels by (i) transversely tilting the side panel until both keys on the side panel fit within the gap between the upper and lower rails, (ii) inserting one of the keys into one of the keyways, (iii) vertically aligning the other one of the keys with the other one of the keyways, and (iv) transversely tilting the side panel towards a vertically upright position whereby the other one of the keys is inserted into the other one of the keyways (d) the defined vertical distance between the rails matches the vertical distance between the back corners of the side panels such that vertical lifting of the side panels is prevented by the location of the top back corner immediately underneath the upper rail.

6. The method of shelf construction in claim 5 wherein the first and second rails and first and second side panels are a material selected from a group which includes hardwood, plywood or particle board.

7. The method of shelf construction in claim 6 wherein the hardwood, plywood or particle board has an ultra violet waterborne finish.

8. The method of shelf construction in claim 5 further including the step of supporting a transversely extending shelf between the first and second side panels.

9. The method of shelf construction in claim 8 wherein the shelf has a transversely extending length of 30 inches-60 inches.

10. The method of claim 5 wherein (-) step (ii) is inserting the key projecting from the bottom back corner of the side panel into the keyway in the lower rail, (-) step (iii) is vertically aligning the key projecting from the top back corner of the side panel with the keyway in the upper rail, and (-) step (iv) is transversely tilting the side panel towards a vertically upright position whereby the key projecting from the top back corner of the side panel is inserted into the keyway in the upper rail.

11. The method of claim 5 wherein the step of transversely tilting the side panel until both keys on the side panel fit within the gap between the upper and lower rails is accomplished after the one of the keys is inserted into the one of the keyways.

12. The method of claim 10 wherein the step of transversely tilting the side panel until both keys on the side panel fit within the gap between the upper and lower rails is accomplished after the key projecting from the bottom back corner of the side panel is inserted into the keyway in the lower rail.

* * * * *